US008002284B1

(12) United States Patent
Hsieh et al.

(10) Patent No.: US 8,002,284 B1
(45) Date of Patent: Aug. 23, 2011

(54) DOLL-BASED GAME MACHINE

(75) Inventors: Kun-Hung Hsieh, Changhua County (TW); Yi-Chiang Yang, Changhua County (TW); Tsair-Rong Chen, Changhua County (TW)

(73) Assignee: Feiloli Electronic Co., Ltd., Hemei Town, Changhua County (TW)

( * ) Notice: Subject to any disclaimer, the term of this patent is extended or adjusted under 35 U.S.C. 154(b) by 0 days.

(21) Appl. No.: 12/843,044

(22) Filed: Jul. 26, 2010

(51) Int. Cl.
*A63F 9/00* (2006.01)

(52) U.S. Cl. ..... 273/448; 273/447; 273/459; 273/460

(58) Field of Classification Search ..... 273/440, 273/445, 447, 448, 454, 459, 460
See application file for complete search history.

(56) References Cited

U.S. PATENT DOCUMENTS

2008/0242413 A1* 10/2008 Matsuda ..... 463/38

FOREIGN PATENT DOCUMENTS

JP 2003154156 A * 5/2003
WO WO 2008153303 A2 * 12/2008

* cited by examiner

*Primary Examiner* — Raleigh W. Chiu

(57) ABSTRACT

A doll-based game machine includes a frame, a doll-hanging unit, a displacement unit, a string-cutting unit and an operation unit. The frame includes an opening defined therein. The doll-hanging unit is located in the frame and used to hang dolls. The displacement unit includes an X-axis displacement unit located in the frame, a Y-axis displacement unit connected to the X-axis displacement unit, and a cutter-carrying unit connected to the Y-axis displacement unit. The string-cutting unit is carried by the cutter-carrying unit. The operation unit is located on the frame and operable to cause the X-axis displacement unit to move the Y-axis displacement unit along an X-axis, to cause the Y-axis displacement unit to move the cutter-carrying unit along a Y-axis, and to turn the string-cutting unit into a cutting mode from an idle mode.

13 Claims, 10 Drawing Sheets

DOLL-BASED GAME MACHINE

BACKGROUND OF INVENTION

1. Field of Invention

The present invention relates to a doll-based game machine and, more particularly, to a string-cutting doll-based game machine.

2. Related Prior Art

A doll-based game machine is conventionally a doll-snatching game machine. After one coin or two are inserted in the doll-snatching game machine through a slot, a claw is operable to snatch one of many dolls located in the doll-snatching game machine.

Such doll-based game machines have been providing entertainment to the public for quite some time. Such doll-based game machines are however loosing their charm. Owners of such doll-based game machines substitute new dolls for old ones regularly, trying to continue to attract customers. The operation of such doll-based game machines has however remained the same and begun to fail to appeal to the customers.

The present invention is therefore intended to obviate or at least alleviate the problems encountered in prior art.

SUMMARY OF INVENTION

It is the primary objective of the present invention to provide a doll-based game machine.

To achieve the foregoing objective of the present invention, the doll-based game machine includes a frame, a doll-hanging unit, a displacement unit, a string-cutting unit and an operation unit. The frame includes an opening defined therein. The doll-hanging unit is located in the frame and used to hang dolls. The displacement unit includes an X-axis displacement unit located in the frame, a Y-axis displacement unit connected to the X-axis displacement unit, and a cutter-carrying unit connected to the Y-axis displacement unit. The string-cutting unit is carried by the cutter-carrying unit. The operation unit is located on the frame and operable to cause the X-axis displacement unit to move the Y-axis displacement unit along an X-axis, to cause the Y-axis displacement unit to move the cutter-carrying unit along a Y-axis, and to turn the string-cutting unit into a cutting mode from an idle mode.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
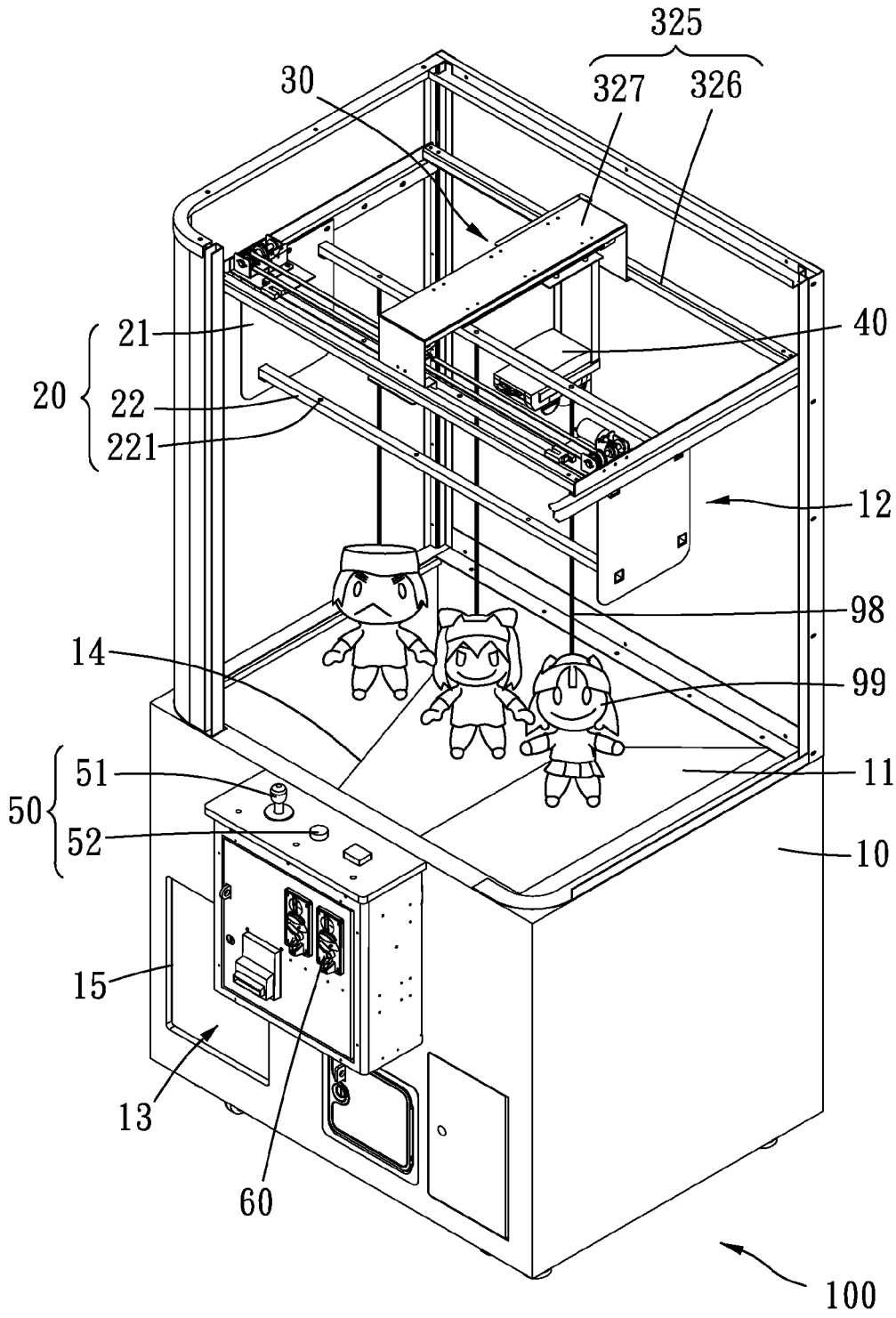
FIG. 1 is a perspective view of a doll-based game machine according to the preferred embodiment of the present invention.

Referring to FIG. 1, a doll-based game machine 100 includes a frame 10, a doll-hanging unit 20, a displacement unit 30, a string-cutting unit 40, an operation unit 50 and a slot unit 60 according to the preferred embodiment of the present invention. The frame 10 is firmly located on the ground or a floor. The frame 10 includes a board 11 located therein to divide the interior thereof into an upper chamber 12 and a lower chamber 13. The upper chamber 12 is in communication with the lower chamber 13 via a channel 14. The board 11 includes a chute extending downwardly toward the channel 14. Furthermore, the frame 10 includes an opening 15 defined in a front panel thereof. The opening 15 is in communication with the lower chamber 13.

The doll-hanging unit 20 includes two plates 21 and several rods 22. The plates 21 are non-movably located in the upper chamber 12. Preferably, each of the plates 21 is attached to a lateral wall of the frame 10 in parallel. Each of the rods 22 includes two ends each secured to a related one of the plates 21. Each of the rods 22 includes apertures 221 defined therein evenly.

Figure 2:
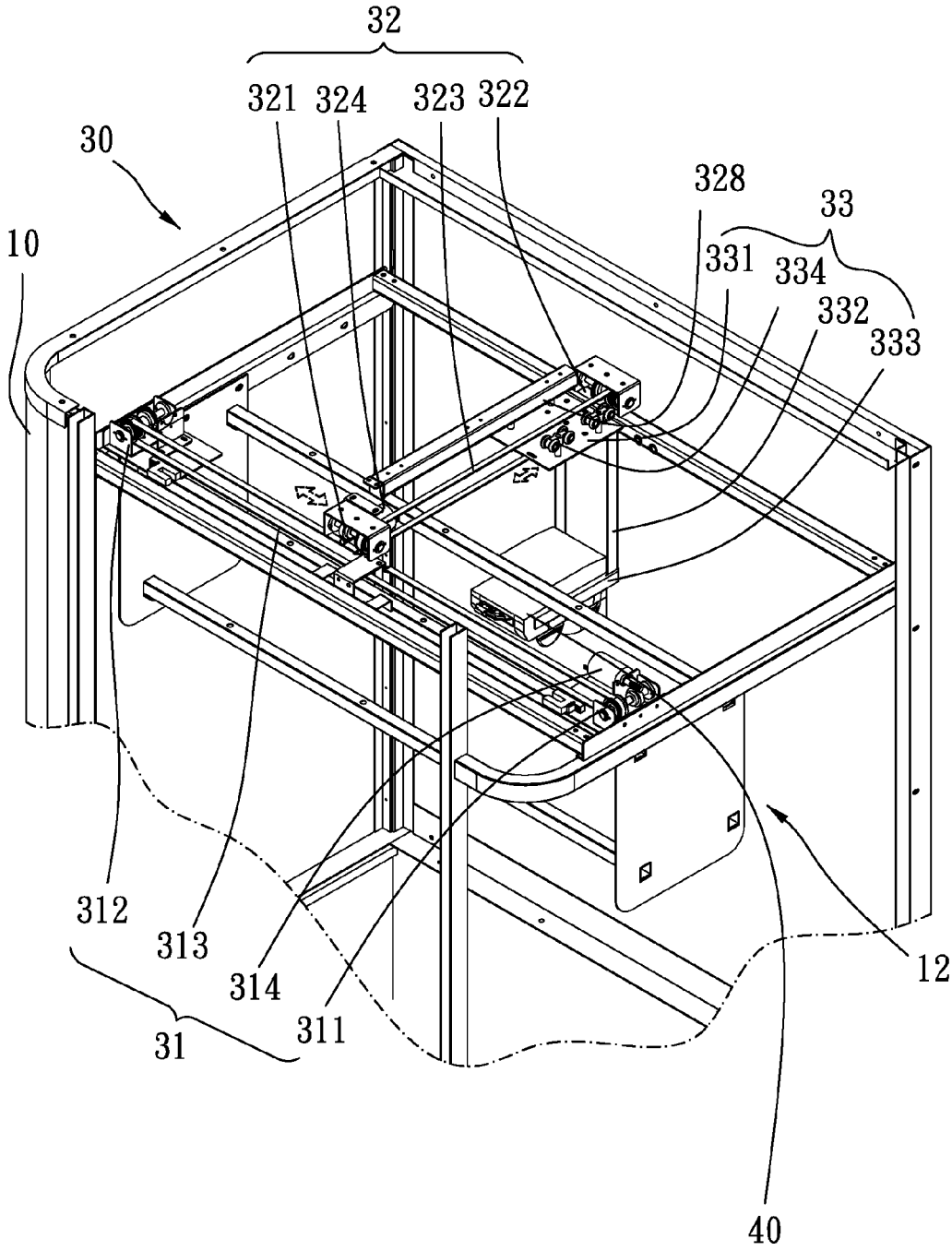
FIG. 2 is a partial view of the doll-based game machine shown in FIG. 1.
Figure 3:
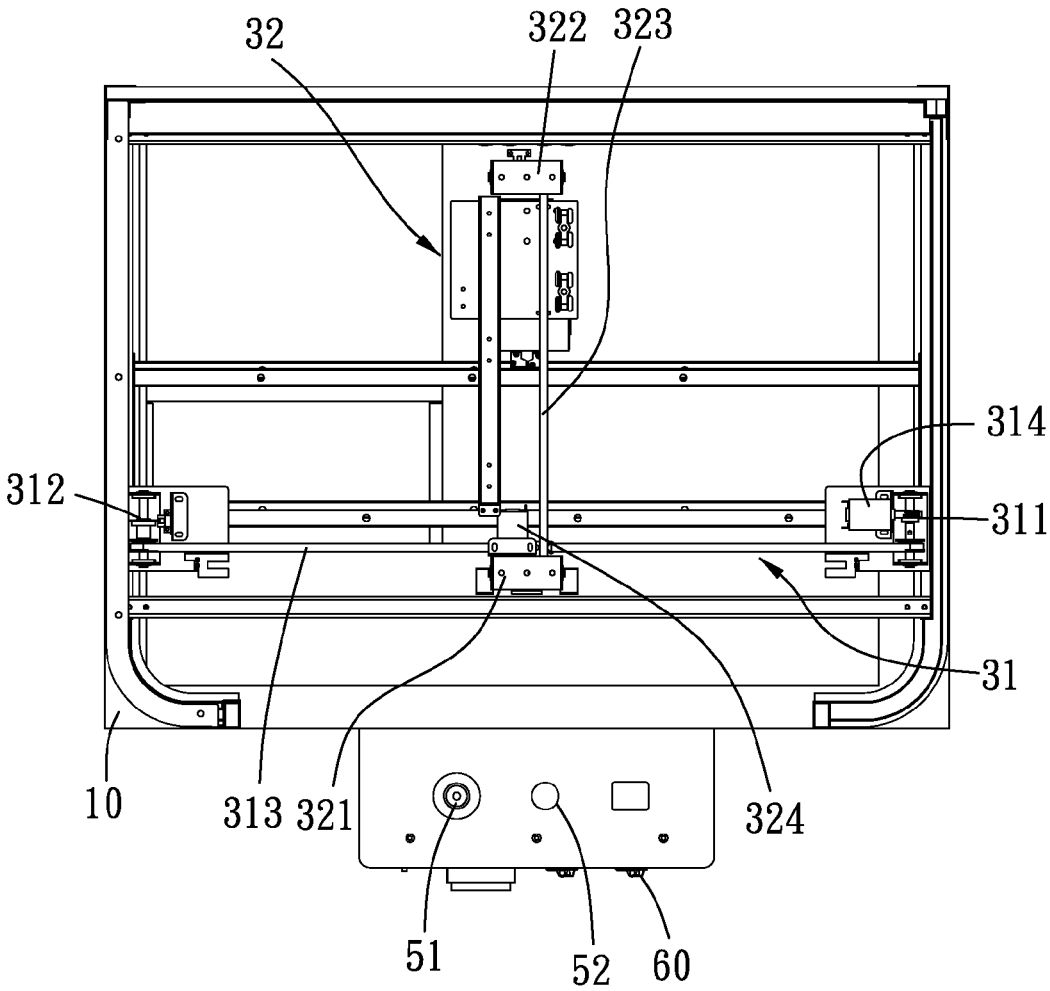
FIG. 3 is a top view of the doll-based game machine shown in FIG. 2.

Referring to FIGS. 1 through 3, the displacement unit 30 includes a track unit 325, an X-axis displacement 31, a Y-axis displacement unit 32 and a cutter-carrying unit 33. The rail unit 325 includes two X-axis tracks 326, a bridge 327 and two Y-axis tracks 328. The X-axis tracks 326 are located in the upper chamber 12 non-movably. The X-axis tracks 326 are in parallel to a rear wall of the frame 11. The bridge 327 includes two ends each movably located on a related one of the X-axis tracks 326. The bridge 327 is in perpendicular to the X-axis tracks 326. Each of the Y-axis tracks 328 includes two ends each connected to a related one of the ends of the bridge 327. The Y-axis tracks 328 are in perpendicular to the X-axis tracks 326.

The X-axis displacement unit 31 includes at least one active pulley 311, at least one follower pulley 312, at lest one belt 313 and at least one motor 314. The pulleys 311 and 312 are rotationally located in the upper chamber 12. The active pulley 311 is located near one of the X-axis tracks 326. The follower pulley 312 is located near the other X-axis track 326. Thus, there is proper spacing between the pulleys 311 and 312. The belt 313 is in the form of a loop wound around the pulleys 311 and 312. The belt 313 is in parallel to the X-axis tracks 326 and located near a front one of the X-axis tracks 326 for example. The motor 314 is connected to the active pulley 311. Thus, the motor 314 can spin the active pulley 311 to drive the belt 313.

The Y-axis displacement unit 32 includes at least one active pulley 321, at lest one follower pulley 322, at least one belt 323 and at least one motor 324. The pulleys 321 and 322 are rotationally located in the upper chamber 12. The active pulley 321 is located near one of the X-axis tracks 326. The follower pulley 322 is located near the other X-axis track 326. Thus, there is proper spacing between the pulleys 321 and 322. The belt 323 is in the form of a loop wound around the pulleys 321 and 322. The belt 323 is located in perpendicular to the X-axis tracks 326. The motor 324 is connected to the active pulley 321. Thus, the motor 324 can spin the active pulley 321 to drive the belt 323.

The active pulley 321 is connected to the belt 313 and a front end of the bridge 327 while the follower pulley 322 is connected to a rear end of the bridge 327. The motor 324 is also connected to the front end of the bridge 327. Thus, the Y-axis displacement unit 32 is carried by the bridge 327, which is movably supported on the X-axis tracks 326.

The cutter-carrying unit 33 includes a first board 331, a plate 332, a second board 333 and four casters 334. The first board 331 is connected to the belt 323. The first board 331 is movable by the belt 323. The plate 332 is connected to the first board 331. The second board 333 is connected to the plate 332. The plate 332 extends vertically between the boards 331 and 332, which extend horizontally. The casters 334 are connected to the first board 331. Two of the casters 334 are movably supported on one of the Y-axis tracks 328. The other casters 334 are movably supported on the other Y-axis track 328. Thus, the cutter-carrying unit 33 is movably supported by the Y-axis tracks 328.

Figure 4:
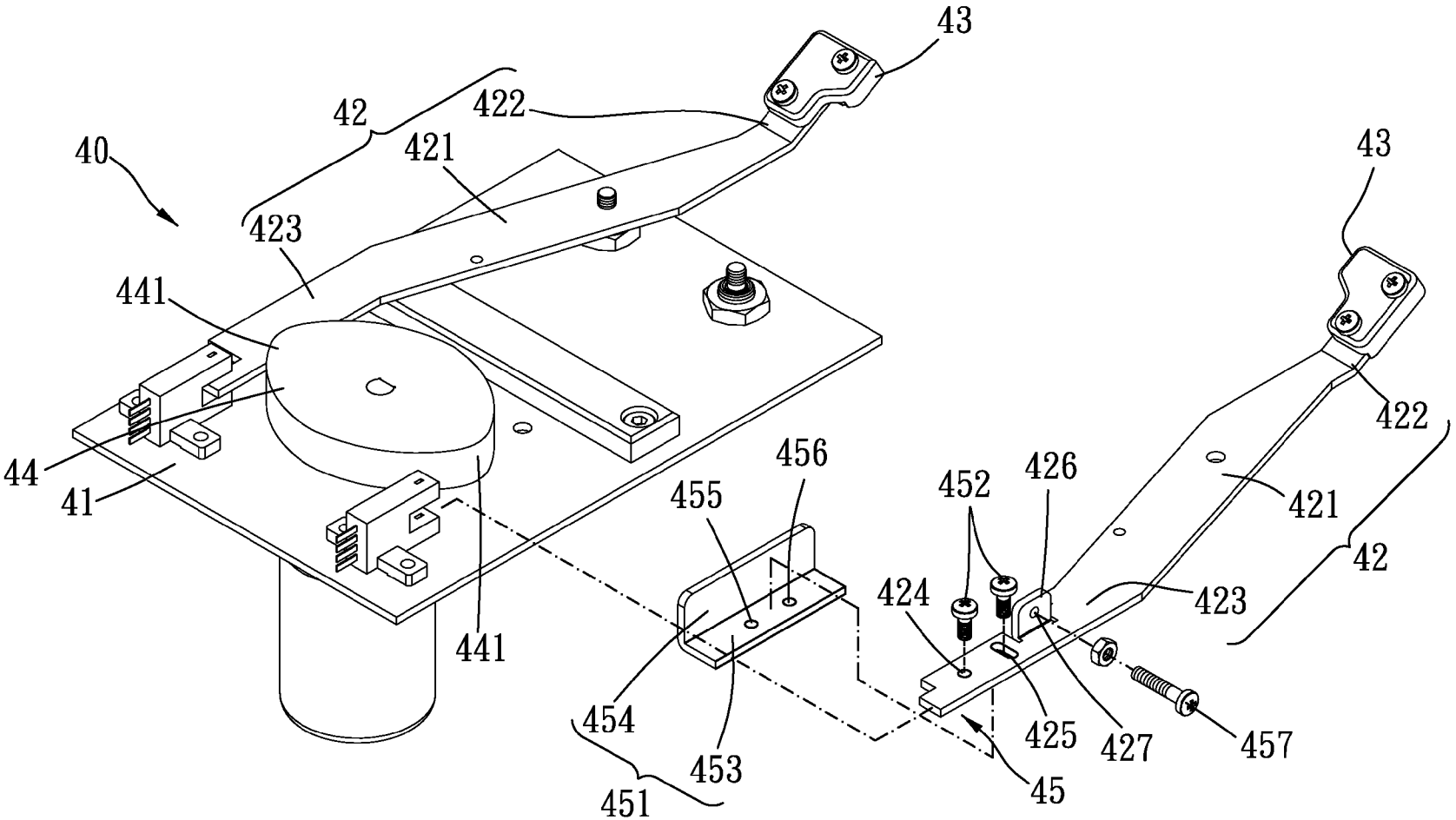
FIG. 4 is an exploded view of a string-cutting unit of the doll-based game machine shown in FIG. 2.
Figure 5:
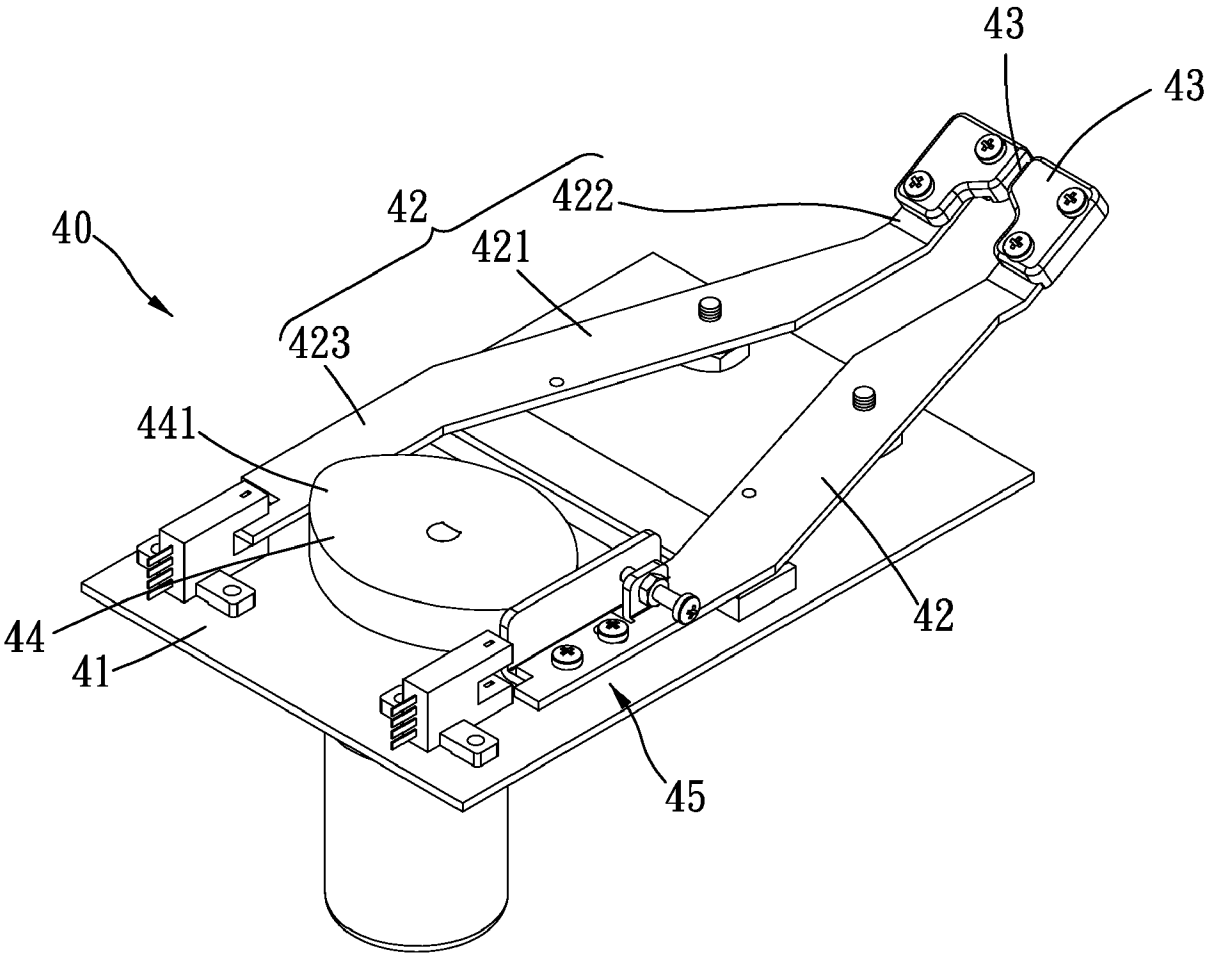
FIG. 5 is a perspective view of the string-cutting unit shown in FIG. 4.

Referring to FIGS. 4 and 5, the string-cutting unit 40 includes a platform 41, two jaws 42, two blades 43, a cam 44 and an adjustment unit 45. The platform 41 of the string-cutting unit 40 is connected to the second board 333 of the cutter-carrying unit 33.

Each of the jaws 42 includes a middle section 421 pivotally supported on the platform 41, a leading section 422 extending from the middle section 421, and a tailing section 423 extending from the middle section 421 opposite to the leading section 422. Each of the blades 43 is secured to the leading section 422 of a related one of the jaws 42. One of the jaws 42 includes an aperture 424 defined therein, an arched slot 425 defined in the tailing section 423 and a lug 426 formed on the tailing section 423. The lug 426 includes a screw hole 427 defined therein.

The cam 44 is oval. The cam 44 includes two opposite lobes 441 formed thereon. The cam 44 is rotationally supported on the platform 41 between the tailing sections 423 of jaws 42. Thus, the cam 44 can be rotated between an active position and an idle position. In the active position of the cam 44, the lobes 441 push the tailing sections 423 of the jaws 42, thus closing the leading sections 422 of the jaws 42. In the idle position of the cam 44, the lobes 441 release the tailing sections 423 of the jaws 42, thus allowing the leading sections 422 of the jaws 42 to open.

The adjustment unit 45 includes a bracket 451, a first screw 452, a second screw 452 and a third screw 457. The bracket 451 includes a horizontal portion 453, a vertical portion 454 extending from the horizontal portion 453, and two screw holes 455 and 456 defined in the horizontal portion 453. The first screw 452 is driven in the screw hole 455 through the aperture 423. The second screw 452 is driven in the screw hole 456 through the arched slot 425. Thus, the bracket 451 is pivotally connected to the related jaw 42. The third screw 457 is driven through the screw hole 427. The tip of the screw 457 is located against the vertical portion 454 of the bracket 451. By spinning the screw 457 in the screw hole 427, the distance between the vertical portion 454 of the bracket 451 and the lug 426 is changed, i.e., the angle between the bracket 451 and the related jaw 42 is changed.

Referring to FIG. 1, the operation unit 50 is located on a front wall of the frame 10. The operation unit 50 is electrically connected to the displacement unit 30 and the string-cutting unit 40. The operation unit 50 includes at east one joystick 51 and at least one button 52. The joystick 51 is operable to maneuver the displacement unit 30. The button 52 is operable to maneuver the string-cutting unit 40.

The slot unit 60 is also located on the front wall of the frame 10. The slot unit 60 is electrically connected to the operation unit 50. The slot unit 60 detects insertion of a coin, a token or a bill therein and hence actuates the operation unit 50.

In operation, dolls 99 are tied to strings 98. An upper section of each of the strings 98 is inserted through a related one of the apertures 221 and made into a knot. Thus, the dolls 99 are hung on the rods 22 as shown in FIG. 1.

Figure 6:
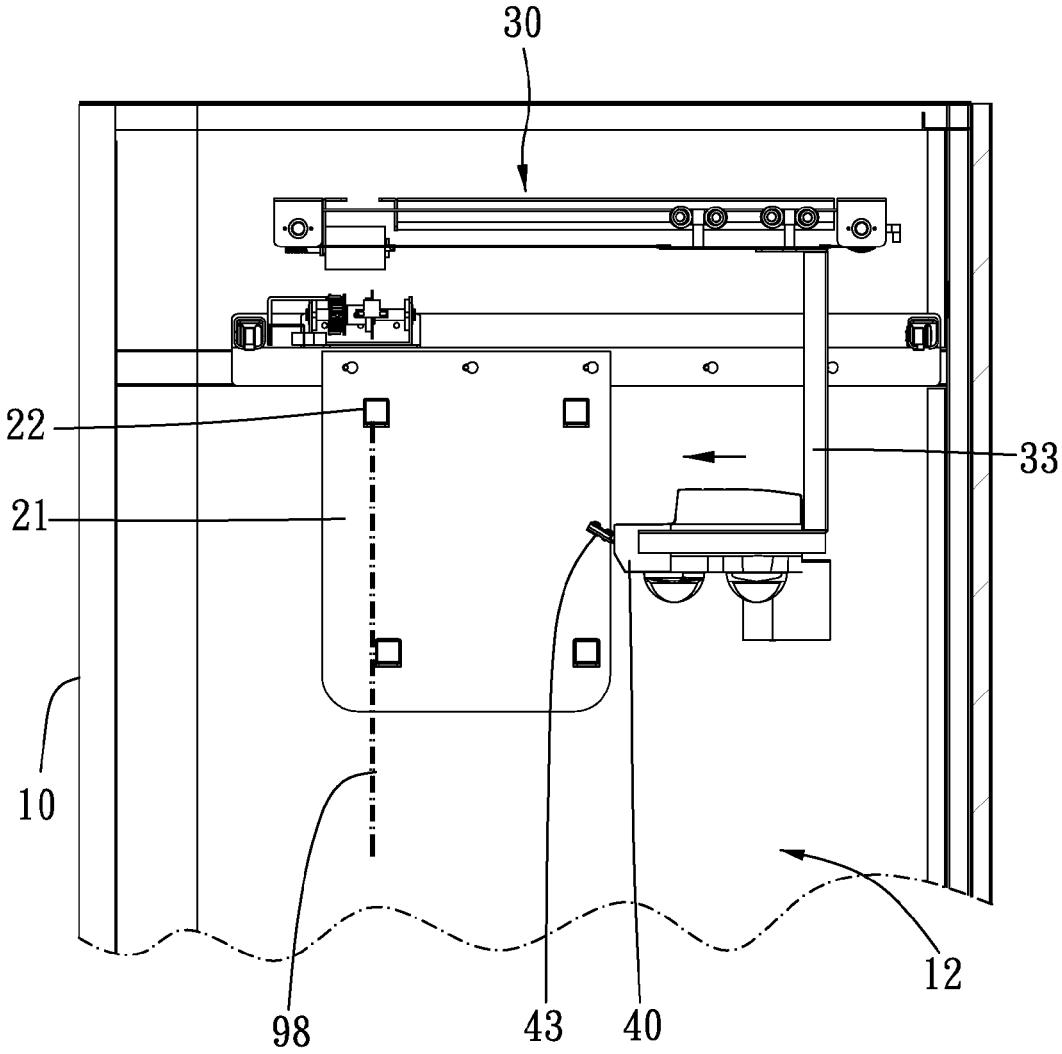
FIG. 6 is a side view of the doll-based game machine shown in FIG. 2.

A customer inserts a coin, a token or a bill into the slot unit 60 to actuate the operation unit 50. Then, the customer maneuvers the joystick 51 to operate the X-axis displacement unit 31 and/or the Y-axis displacement unit 32 to move the string-cutting unit 40 along an X-axis and/or a Y-axis extending in perpendicular to the X-axis as shown in FIGS. 2, 3 and 6.

Figure 7:
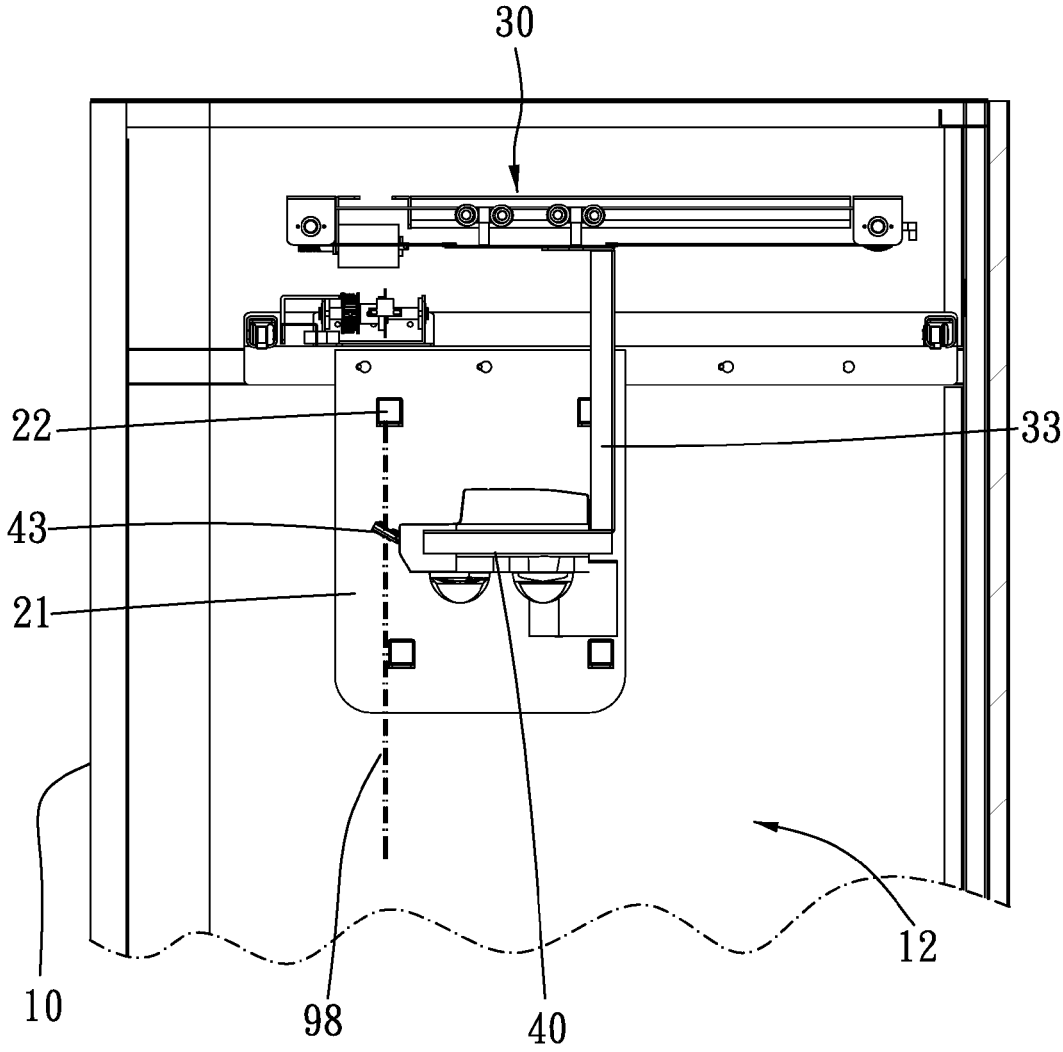
FIG. 7 is a side view of the doll-based game machine in another position than shown in FIG. 6.
Figure 8:
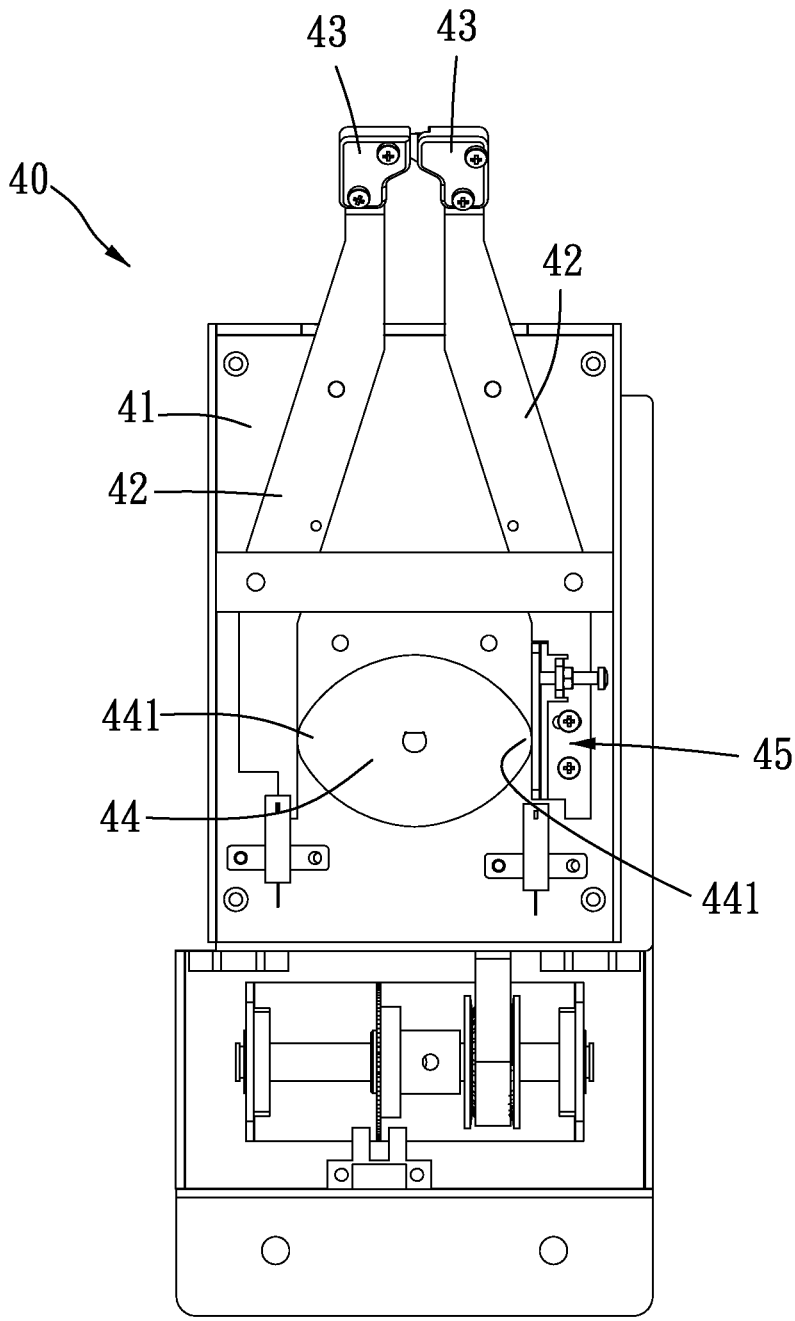
FIG. 8 is a top view of the string-cutting unit shown in FIG. 7.

Having located the string-cutting unit 40 in a desired position, the customer pushes the button 52 to spin the cam 44 for 90°. Thus, one of the lobes 441 abuts the tailing section 423 of one of the jaws 42 while the other lobe 441 abuts the vertical portion 454 of the bracket 451 and therefore the tailing section 423 of the other jaw 42. Hence, the blades 43 provided on the leading sections 422 of the jaws 42 are closed as shown in FIGS. 7 and 8. If the string-cutting unit 40 is in the right position, a selected one of the strings 98 will be cut, and a desired one of the dolls 99 is released and dropped into the lower space 13 from the upper space 12 through the channel 14. The customer can get the desired doll 99 from the lower space 13 through the opening 15.

Figure 9:
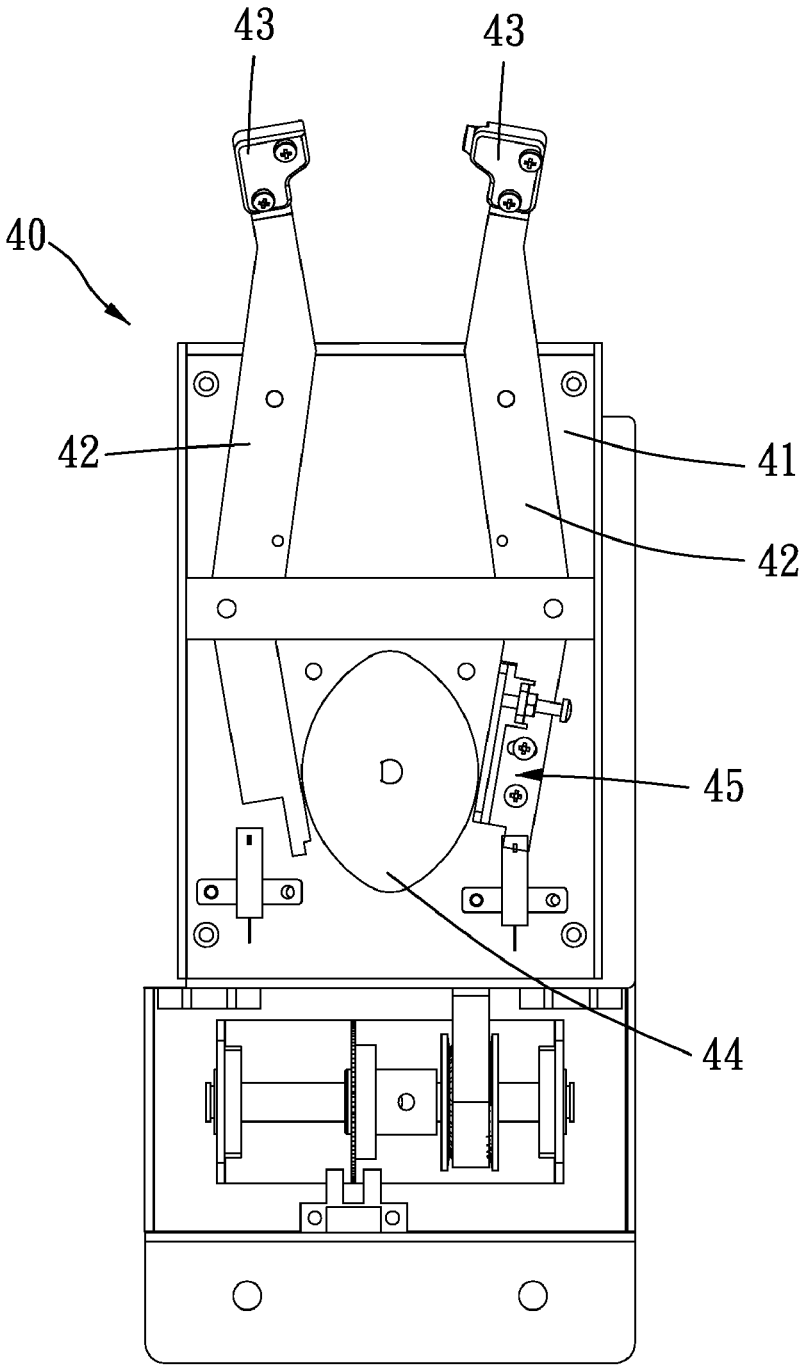
FIG. 9 is a top view of the string-cutting unit in another position than shown in FIG. 8.

After a predetermined period of time, the cam 44 is spun for another 90°. Thus, the lobes 441 release the tailing section 423 of one of the jaws 42 and the vertical portion 454 of the bracket 451, respectively. Hence, the blades 43 provided on the leading sections 422 of the jaws 42 and are opened as shown in FIG. 9. Then, the displacement unit 30 is automatically actuated to return the string-cutting unit 40 to its original position.

Figure 10:
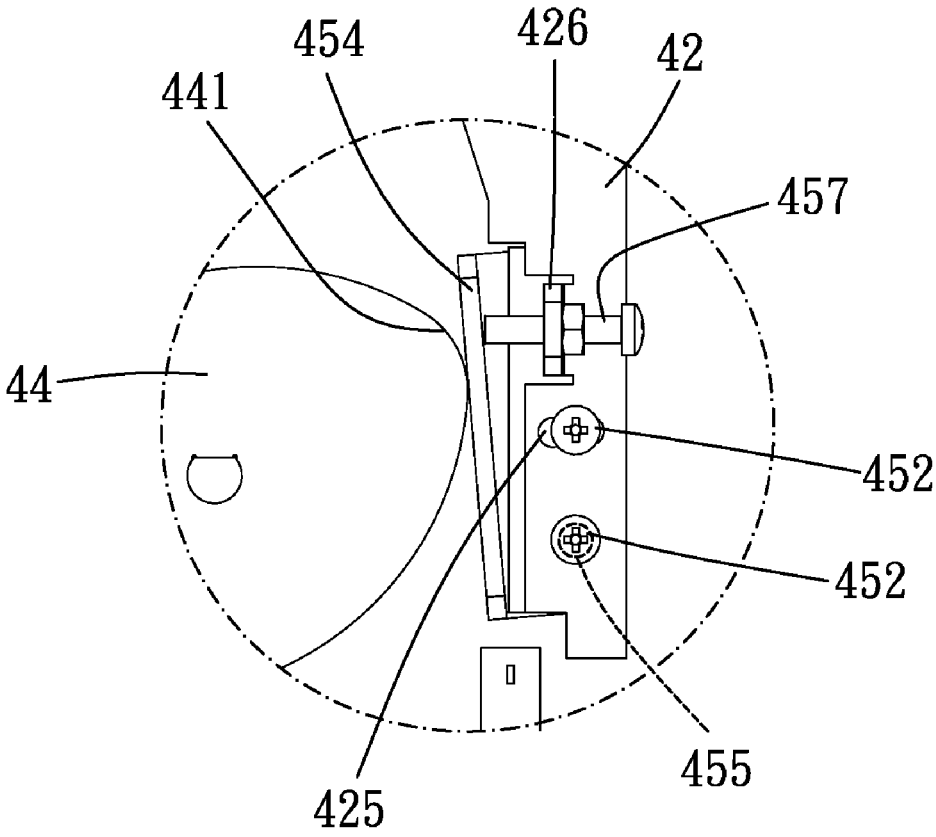
FIG. 10 is a partial view of the string-cutting unit shown in FIG. 9.

The blades 43 are inevitably worn away after some time of use. To compensate the wearing away of the blades 43, an owner of the doll-based game machine 100 spins the screw 457 in the screw hole 427 defined in the lug 426 to enlarge the distance between the vertical portion 454 of the bracket 451 and the tailing section 423 of the related jaw 42 as shown in FIG. 10. Therefore, the angle between the tailing sections 423 of the jaws 42 is enlarged. Accordingly, the leading sections 422 of the jaws 42 are brought closer to each other.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A doll-based game machine including:

a frame including an opening defined therein;

a doll-hanging unit located in the frame and used to hang dolls;

a displacement unit including an X-axis displacement unit located in the frame, a Y-axis displacement unit connected to the X-axis displacement unit, and a cutter-carrying unit connected to the Y-axis displacement unit;

a string-cutting unit carried by the cutter-carrying unit; and an operation unit located on the frame and operable to cause the X-axis displacement unit to move the Y-axis displacement unit along an X-axis, to cause the Y-axis displacement unit to move the cutter-carrying unit along a Y-axis, and to turn the string-cutting unit into a cutting mode from an idle mode.

2. The doll-based game machine according to claim 1, wherein the frame includes a board located therein to divide the interior thereof into an upper chamber for containing the dolls, a lower chamber in communication with the opening, and a channel via which the dolls can be dropped into the lower chamber from the upper chamber.

3. The doll-based game machine according to claim 1, wherein the doll-hanging unit includes:

two plates each attached to a lateral wall of the frame; and rods each including two ends each connected to a related one of the plates and apertures evenly defined therein, wherein each of the apertures can receive a string tied to each of the dolls.

4. The doll-based game machine according to claim 1, wherein the X-axis displacement unit includes:

at least one active pulley;

a follower pulley;

a belt in the form of a loop wound around the active and follower pulleys; and a motor connected to the active pulley so that the motor can spin the active pulley to drive the belt.

5. The doll-based game machine according to claim 4, wherein the Y-axis displacement unit includes:

at least one active pulley connected to the belt of the X-axis displacement unit so that the latter can drive the former;

a follower pulley;

a belt in the form of a loop wound around the active and follower pulleys thereof, wherein the belt of the Y-axis displacement unit extends in perpendicular to the belt of the X-axis displacement unit, wherein the cutter-carrying unit is attached to the belt of the Y-axis displacement unit; and a motor connected to the active pulley thereof so that the motor can spin the active pulley thereof to drive the belt thereof.

6. The doll-based game machine according to claim 5, wherein the displacement unit includes a track unit including:

two X-axis tacks located in parallel to the belt of the X-axis displacement unit; and a bridge movably supported on the X-axis tracks, wherein the active and follower pulleys and the motor of the Y-axis displacement nit are attached to the bridge.

7. The doll-based game machine according to claim 6, wherein the track unit includes two Y-axis tracks connected to the bridge in parallel to the belt of the Y-axis displacement unit, wherein the cutter-carrying unit includes:

a first board connected to the belt of the Y-axis displacement unit;

a plate connected to the board in perpendicular;

a second board connected to the plate in perpendicular, and four casters connected to the first board, wherein two of the casters are located on one of the Y-axis tracks while the other casters are located on the other Y-axis track.

8. The doll-based game machine according to claim 1, wherein the string-cutting unit includes:

a platform connected to the cutter-carrying unit;

two jaws each including a leading section pivotally connected to the platform thereof, a leading section extending from the middle section, and a tailing section extending from the middle section opposite to the leading section;

two blades each attached to the leading section of a related one of the jaws; and a cam including two opposite lobes formed thereon, wherein the cam can be spun between an active position where the lobes push open the tailing sections of the jaws to close the blades attached to the leading sections of the jaws and an idle position where the lobes release the tailing sections of the jaws to allow the blades attached to the leading sections of the jaws to open.

9. The doll-based game machine according to claim 8, wherein the string-cutting unit includes an adjustment unit for adjusting the distance between the tailing sections of the jaws.

10. The doll-based game machine according to claim 9, wherein one of the jaws includes an aperture defined therein, an arched slot defined therein, a tab formed thereon, and a screw hole defined in the tab, wherein the adjustment unit includes:

a bracket including a horizontal portion, a vertical portion extending from the horizontal portion, a first screw aperture defined in the horizontal portion, and a second screw aperture defined in the horizontal portion;

a first screw driven in the first screw aperture through the aperture defined in the related jaw;

a second screw driven in the second screw aperture through the arched slot defined in the related jaw; and a third screw driven through the screw hole defined in the tab and abutted against the vertical portion of the bracket.

11. The doll-based game machine according to claim 1, further including a slot unit located on the frame and electrically connected to the operation unit, wherein the slot unit detects a desired object inserted by a customer and hence actuates the operation unit.

12. The doll-based game machine according to claim 11, wherein the operation unit includes at least one joystick operable to actuate the displacement unit and at least one button operable to actuate the string-cutting unit.

13. A string-cutting unit for use in a doll-based game machine, wherein the string-cutting unit includes:

a platform;

two jaws each including a leading section pivotally connected to the platform thereof, a leading section extending from the middle section, and a tailing section extending from the middle section opposite to the leading section, wherein one of the jaws includes an aperture defined therein, an arched slot defined therein, a tab formed thereon, and a screw hole defined in the tab:

two blades each attached to the leading section of a related one of the jaws;

a cam including two opposite lobes formed thereon, wherein the cam can be spun between an active position where the lobes push open the tailing sections of the jaws to close the blades attached to the leading sections of the jaws and an idle position where the lobes release the tailing sections of the jaws to allow the blades attached to the leading sections of the jaws to open; and an adjustment unit including:

a bracket including a horizontal portion, a vertical portion extending from the horizontal portion, a first screw aperture defined in the horizontal portion, and a second screw aperture defined in the horizontal portion;

a first screw driven in the first screw aperture through the aperture defined in the related jaw;

a second screw driven in the second screw aperture through the arched slot defined in the related jaw; and a third screw driven through the screw hole defined in the tab and abutted against the vertical portion of the bracket.

* * * * *

UNITED STATES PATENT AND TRADEMARK OFFICE

CERTIFICATE OF CORRECTION

PATENT NO. : 8,002,284 B1
APPLICATION NO. : 12/843044
DATED : August 23, 2011
INVENTOR(S) : Kun-Hung Hsieh et al.

It is certified that error appears in the above-identified patent and that said Letters Patent is hereby corrected as shown below:

Title page, item [73] assignee should read as follows: Feiloli Electronic Co., Ltd., Hemei Town, Changhua County, Taiwan; Department Of Electrical Engineering, National Changhua University Of Education, Changhua, Taiwan Signed and Sealed this
Sixth Day of August, 2013

Teresa Stanek Rea
*Acting Director of the United States Patent and Trademark Office*